US011702823B2

(12) United States Patent
Benstead

(10) Patent No.: US 11,702,823 B2
(45) Date of Patent: Jul. 18, 2023

(54) TOP-MOUNT FAUCET

(71) Applicant: Spectrum Brands, Inc., Middleton, WI (US)

(72) Inventor: Evan Benstead, Los Angeles, CA (US)

(73) Assignee: Spectrum Brands, Inc., Middleton, WI (US)

( * ) Notice: Subject to any disclaimer, the term of this patent is extended or adjusted under 35 U.S.C. 154(b) by 107 days.

(21) Appl. No.: 16/672,033

(22) Filed: Nov. 1, 2019

(65) Prior Publication Data

US 2020/0157787 A1 May 21, 2020

Related U.S. Application Data

(60) Provisional application No. 62/767,909, filed on Nov. 15, 2018.

(51) Int. Cl.
*E03C 1/04* (2006.01)

(52) U.S. Cl.
CPC ..... *E03C 1/0402* (2013.01)

(58) Field of Classification Search
CPC ..... E03C 1/0401; E03C 1/0402; E03C 1/0403
See application file for complete search history.

(56) References Cited

U.S. PATENT DOCUMENTS

| | | | | |
|---|---|---|---|---|
| 4,281,857 | A * | 8/1981 | Randall | E03C 1/0401 4/695 |
| 5,946,746 | A | 9/1999 | Bloom | |
| 6,138,296 | A | 10/2000 | Baker | |
| 6,328,059 | B1 * | 12/2001 | Testori | E03C 1/0401 137/315.12 |
| 10,683,646 | B2 | 6/2020 | Pei et al. | |
| 2006/0076056 | A1 * | 4/2006 | Schmitt | E03C 1/0401 137/216 |
| 2016/0258142 | A1 | 9/2016 | Zou et al. | |

FOREIGN PATENT DOCUMENTS

| | | | | |
|---|---|---|---|---|
| CN | 202252333 U | | 5/2012 | |
| CN | 103243782 A | * | 8/2013 | E03C 1/0402 |
| CN | 103669499 A | | 3/2014 | |
| CN | 104674904 A | | 6/2015 | |
| CN | 105862997 A | | 8/2016 | |
| FR | 2 525 296 | | 10/1983 | |
| FR | 2525296 A1 | * | 10/1983 | E03C 1/0401 |

OTHER PUBLICATIONS

International Search Report and Written Opinion for Application No. PCT/US2019/061498 dated Feb. 13, 2020.
First Office Action and English Translation of First Office Action, Chinese Patent Application No. 201980081209.6, dated Oct. 27, 2022 (22 total pages).

* cited by examiner

*Primary Examiner* — Erin Deery
(74) *Attorney, Agent, or Firm* — Merchant & Gould P.C.

(57) ABSTRACT

A method and apparatus used to secure a faucet to a countertop includes a brace with legs joined together at a nut, thereby allowing the legs to pivot about a horizontal axis of the nut. The nut is joined to a threaded rod that extends from a base of a faucet. The legs of the brace pivot such that the legs are both parallel to the threaded rod with one part of the brace above the horizontal axis of the nut and one part of the brace below the horizontal axis of the nut. The threaded rod and brace may then be inserted into a countertop mounting hole. The threaded rod is rotated from above the countertop, thereby drawing the brace towards the countertop and securing the faucet.

20 Claims, 7 Drawing Sheets

TOP-MOUNT FAUCET

CROSS-REFERENCE TO RELATED APPLICATION(S)

This application claims the benefit of U.S. Provisional Application No. 62/767,909, filed Nov. 15, 2018, which application is hereby incorporated by reference in its entirety.

TECHNICAL FIELD

This invention relates to the field of faucets. In particular, the invention relates to a method and a device that allows for installation of a faucet from above a countertop, without the need to access mounting fasteners below the countertop.

BACKGROUND OF THE INVENTION

Faucet installation is typically a frustrating experience for many. A fastener, such as a nut and a large washer or plate, is typically attached to a faucet body from beneath a countertop. The space beneath a countertop where a faucet is installed is commonly poorly lit, cramped, and filled with household goods. The process of laying on one's back with a flashlight and using a wrench while in the upside down position requires a level of flexibility and manual dexterity. As faucets are typically located behind sinks, the sink bowl presents an obstruction to the faucet fasteners below the countertop. Installers may need to install the faucet without being able to see the actual connection. Use of deep-basin sinks makes the installation process even harder by further limiting access space.

There have been previous attempts to address the above-mentioned problems. There remains a need for additional solutions and improvements in the field. The invention disclosed herein addresses this long felt need.

OBJECTS AND SUMMARY OF THE INVENTION

A method of attaching a faucet to a countertop as well as the related apparatus is herein described. The faucet may be attached to the countertop from above the countertop without necessitating access under the countertop. The method and apparatus include detaching a spout from a faucet body to gain access to a hollow, threaded rod within the faucet body. A brace is attached to the threaded rod with a central, female threaded nut and legs extending from the nut at opposing sides. The legs are joined together at the nut, thereby allowing the legs to pivot about a horizontal axis of the nut. The nut is threaded to the threaded rod that extends from a base of the faucet body. The nut is threaded sufficiently to the threaded rod leaving a space between the base of the faucet body and the brace greater than a thickness of the countertop. The brace and threaded rod are then inserted into a mounting hole in the countertop. The legs of the brace are pivoted such that the legs are both parallel to the threaded rod with one leg above the horizontal axis of the nut and one leg below the horizontal axis of the nut. This allows the brace to fit within the mounting hole as it is inserted into the countertop. The faucet body is then lowered to the countertop until the base of the faucet body abuts the countertop surface covering the mounting hole.

The threaded rod may then be rotated with a tool while the faucet body is maintained in a stationary position. While the threaded rod is rotated, the brace is prevented from rotating.

The threaded engagement of the nut to the threaded rod draws the brace towards the countertop as the threaded rod is rotated, thereby reducing the space between the brace and the countertop. If the legs of the brace are still parallel to the threaded rod, the legs will pivot once they contact the countertop. The legs of the brace pivot such that they are both parallel to the countertop and perpendicular to the threaded rod. The threaded rod may continuously be rotated until there is a sufficient clamping pressure between the brace and the countertop, therefore sufficiently mounting the faucet body to the countertop.

Prior to inserting the threaded rod and brace into the countertop mounting hole, the cold water and hot water supply lines are connected to a valve within the faucet body. This prevents a need to connect the lines below the countertop. Similarly, a hose for joining a spray head to the valve may be passed through a central passage extending through the threaded rod, as the threaded rod is hollow. After the hose is passed through the threaded rod and the faucet is attached to the countertop, a hose connector can be attached to the end of the hose.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
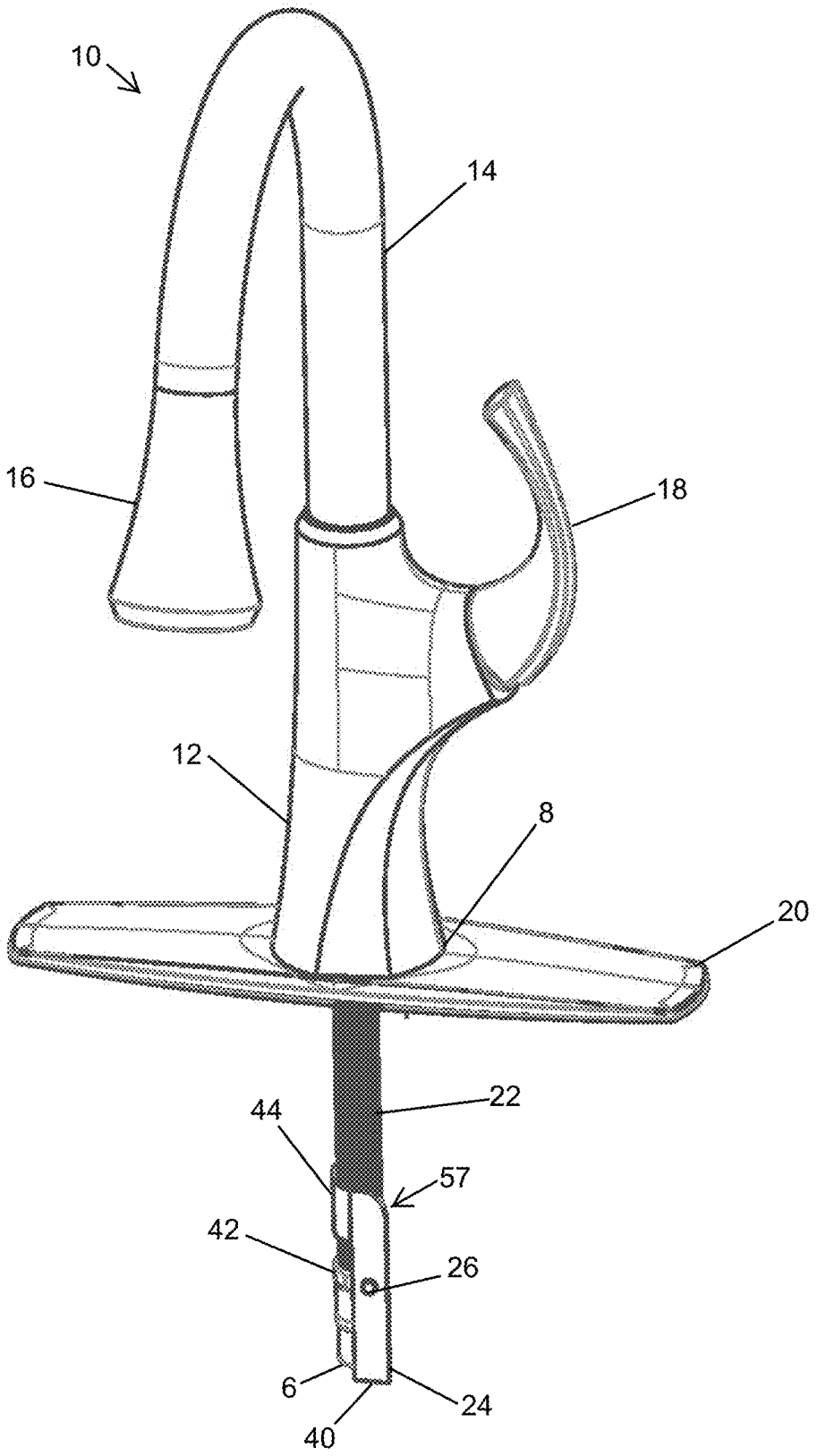
FIG. 1 shows a perspective view of the top mount faucet.

FIG. 1 shows a faucet 10 according to an embodiment of the invention. The faucet 10 has a body 12 configured for installation in a suitable substrate such as a countertop. A base 8 of the faucet 10 is flat and configured to rest on the countertop above a mounting hole. A threaded rod 22 extends from the base 8 of the body 12. The threaded rod 22 attaches to a brace 24 with corresponding threads on the brace 24. The brace 24 functions as an anchor when attaching the faucet 10 to a countertop.

The faucet 10 includes a handle 18 allowing manual adjustment of the temperature and volume of the water flow. Hot and cold water is supplied via hoses to a valve (not pictured) within the body 12. The handle 18 allows a user to manually operate the valve. The desired water temperature and volume flows from the valve through a hose that is passed through an inlet 6 of the threaded rod 22. The hose 7 is passed through the entire threaded rod 22, as it is hollow, through the body 12, through a spout 14, and is joined to a head 16. The head 16 may be removed from the spout 14 allowing a user to direct the spray of water from the head 16 to a desired location. Lastly, an optional flange 20 may be used when installing the faucet 10. The flange 20 is included for aesthetic purposes and may be used to cover additional holes in the countertop that are unused.

When installing the faucet 10, it can be difficult to gain proper access below the countertop. Proper access is often needed to sufficiently secure the faucet to the countertop. The inventive faucet 10 therefore includes the brace 24 that engages the threaded rod 22. The threaded rod 22 includes threads on the entire exterior of the threaded rod 22. The brace 24 includes a threaded nut 42 attached to legs 40 about a pivot 26. The legs 40 are parallel 57 and are joined at one end with a bridge 44 and open at an opposing end. As the legs 40 pivot about the pivot 26, the bridge 44 contacts the threaded rod 22. The bridge 44 has a curvature that matches the curvature of the threaded rod 22, thereby allowing the bridge 44 to "hug" the threaded rod 22 and nest against it. This nesting action lowers the cross sectional area of the bridge 44 and threaded rod 22 allowing the combination to be inserted into a hole in a countertop.

Figure 2:
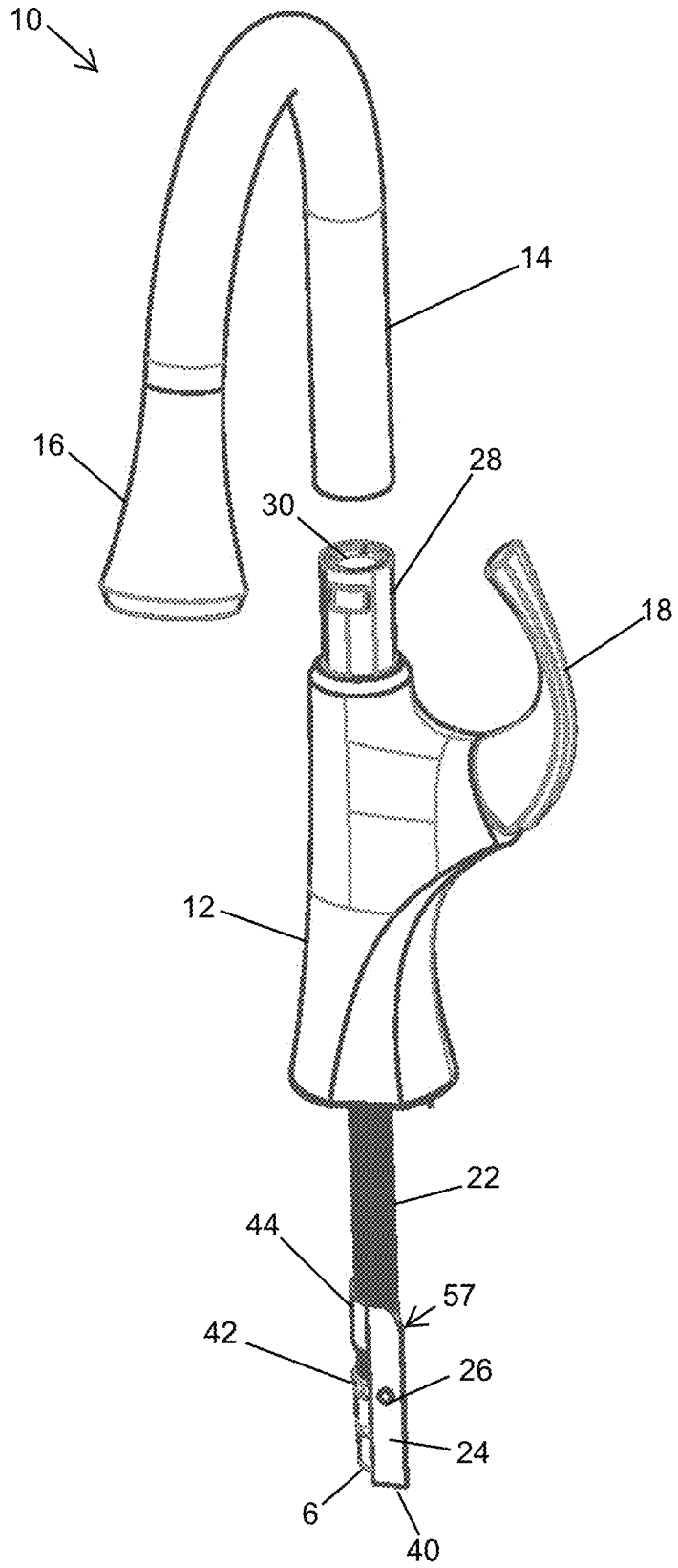
FIG. 2 shows a partially exploded perspective view of the top mount faucet according to FIG. 1.

As shown in FIG. 2, the spout 14 may be detached from the body 12. A spout retainer 28 engages the spout 14 and may be selectively released for spout removal. An internal cavity 30 within the spout retainer 28 extends through the body 12 providing a hollow passage through the body 12 and through the threaded rod 22. The internal cavity 30 also extends throughout the spout 14 for a water supply hose 7. When installing the faucet 10, the hose 7 is detached from the head 16 and removed from the internal cavity 30 to allow proper access.

Figure 3:
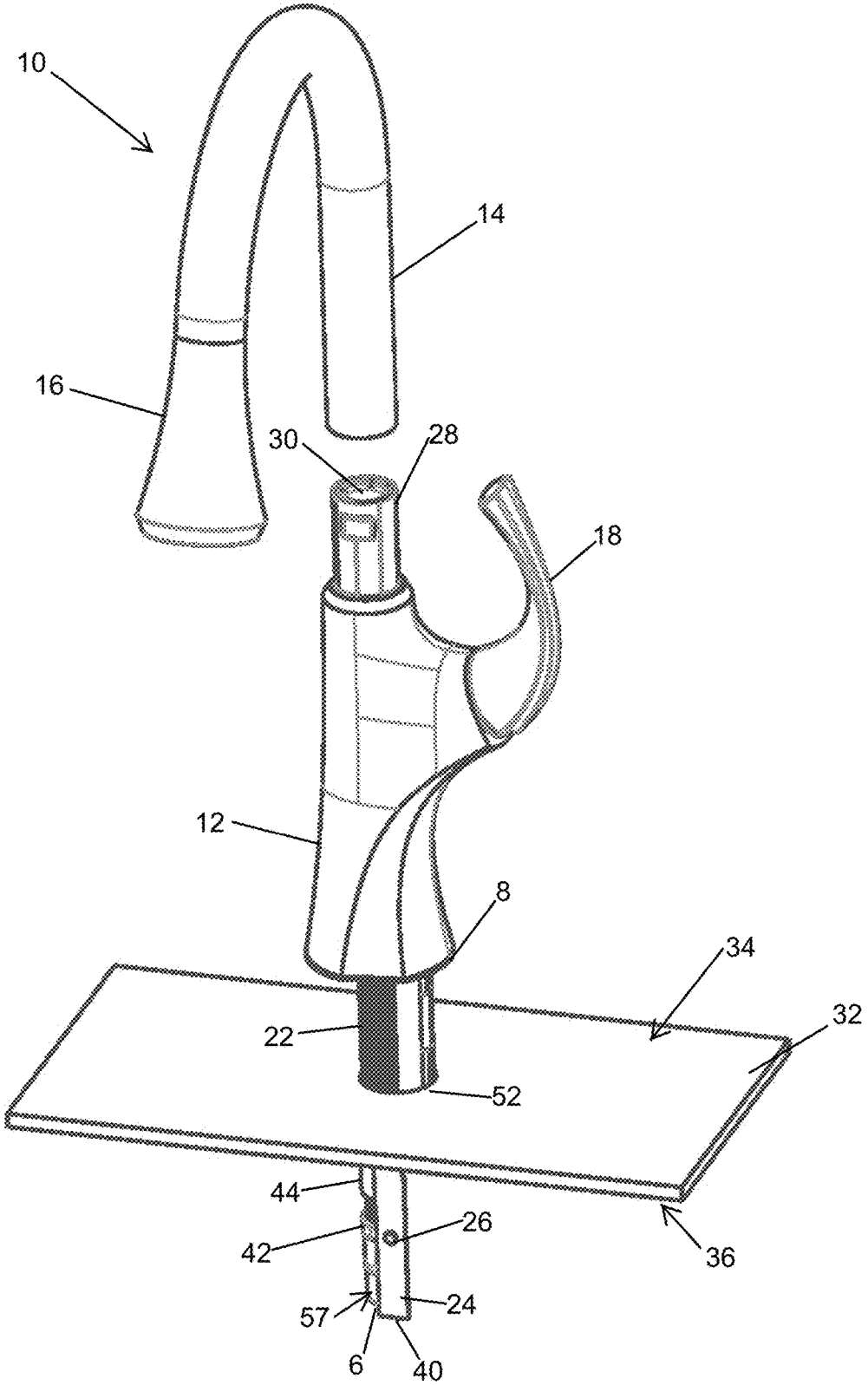
FIG. 3 shows a partially exploded perspective view of the top mount faucet according to FIG. 1 that is partially installed in a countertop.

After the spout 14 is detached from the body 12, as also shown in FIG. 3, the brace 24 and threaded rod 22 are inserted into a mounting hole 52 in the countertop 32. The legs 40 of the brace 24 are pivoted about the pivot 26 such that they are parallel 57 to the threaded rod 22. The legs 40 are fully pivoted until the bridge 44 contacts the threaded rod 22. Once fully pivoted, the brace 24 may fit into the mounting hole 52 along with the threaded rod 22 to which it is attached. The brace 24 will not pass through the mounting hole 52 without pivoting, as it is too long. The length of the brace 24 provides for proper strength as it is tightened in place when mounting the faucet 10 to a countertop 32 as explained below.

Figure 4:
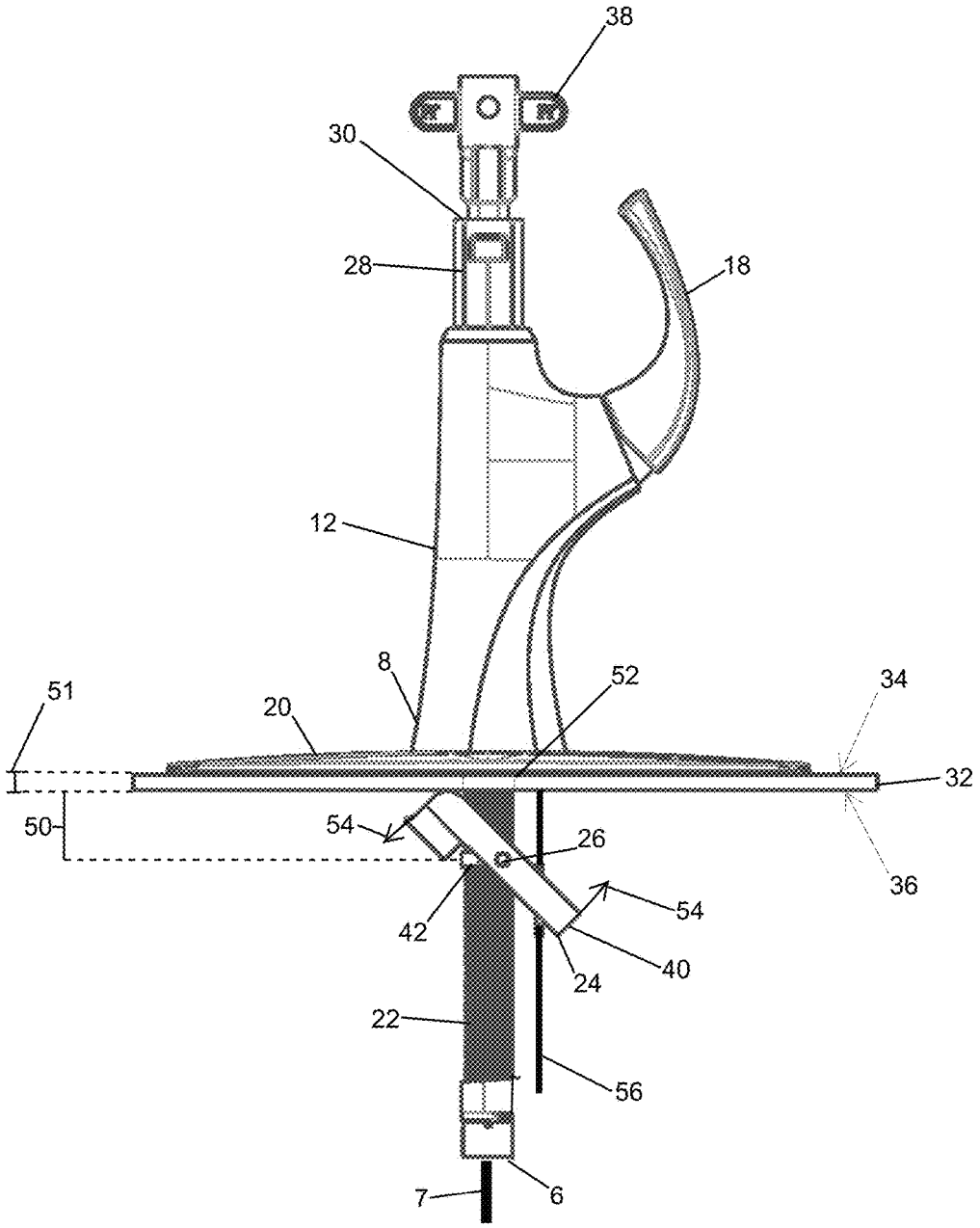
FIG. 4 shows a front view of the body of the top mount faucet according to FIG. 1 as it is attached to a countertop.

The threaded nut 42 on the brace 24 engages the threads on the threaded rod 22. The brace 24 is threaded onto the threaded rod 22, leaving enough clearance between the base 8 of the body and the brace 24 to allow the legs 40 to fully pivot to a horizontal position, or perpendicular to the threaded rod 22, after it is inserted into the mounting hole 52. For example, FIG. 4 shows a space 50 that provides clearance between the threaded nut 42 and a bottom 36 of the countertop 32. This clearance space allows the brace 24 to move in a pivoting motion 54 so that it is perpendicular to the threaded rod 22. In some examples, the space 50 is greater than or equal to a thickness 51 of the countertop 32. Once in the perpendicular position, the legs 40 will not clear the mounting hole 52.

The legs 40 may pivot about the pivot 26 as the threaded rod 22 is rotated. The threaded rod 22 may be rotated in place, without displacement. This rotational motion of the threaded rod 22 draws the brace 24 towards the base 8 and bottom 36 of the countertop 32 due to the engaging threads on each respective part. The brace 24 may be secured by simply pulling up on the body 12 of the faucet 10 as the threaded rod 22 is rotated. Securing the brace 24 in such a manner keeps the brace 24 in place and allows the rotating action to decrease the space 50 if the threaded rod 22 is rotated in one direction, or increase the space 50 if the threaded rod 22 is rotated in an opposite direction.

The threaded rod 22 may be rotated from a top side 34 of the countertop 32 with the use of a tool 38. While a specific tool 38 is shown in FIG. 4, any suitable tool may be used, such as a screwdriver, hex key, socket wrench, or the like. The threaded rod 22 includes a receptacle within the internal cavity 30 that allows it to engage the tool 38. As a result, the threaded rod 22 may be rotated, thereby drawing the brace 24 towards the bottom 36 of the countertop 32 all from above the top 34 of the countertop 32. Since the brace 24 may be joined to the threaded rod 22 before they are inserted into the mounting hole 52, the entire operation of securing the faucet 10 to the countertop 32 may be accomplished without access to the bottom 36 of the countertop 32, other than through the mounting hole 52.

Figure 5:
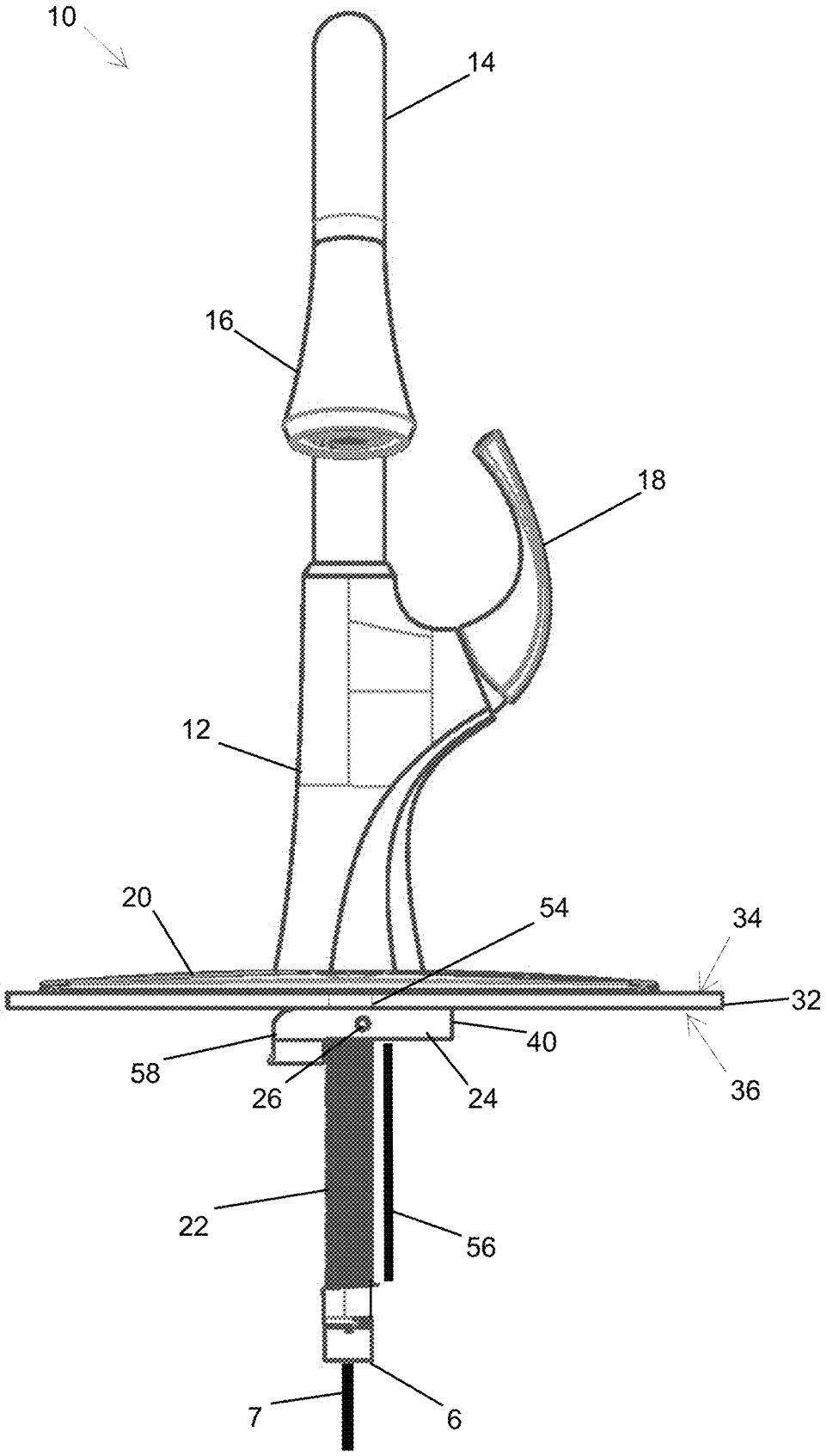
FIG. 5 shows a front view of the top mount faucet according to FIG. 1 attached to a countertop.

As previously discussed, if the legs 40 are parallel 57 (see FIG. 3) to the threaded rod 22 while the threaded rod 22 is rotated with the tool 38, contact with the bottom 36 of the countertop 32 will cause a pivoting motion 54 action as shown in FIG. 4. The legs 40 continue to pivot about the pivot 26 as the brace 24 is drawn towards the bottom 36 of the countertop 32 until they are perpendicular 58 to the threaded rod 22 as shown in FIG. 5. Once adequate torque is applied to the tool 38 and the brace 24 is sufficiently tight against the bottom 36 of the countertop 32, the tool 38 may be removed and the spout 14 re-connected to the spout retainer 28 of the body 12. The water delivery hose 7 may also be fed through the internal cavity 30 and inlet 6 of the threaded rod 22 and connected to the head 16 prior to re-attachment of the spout 14.

Figure 6:
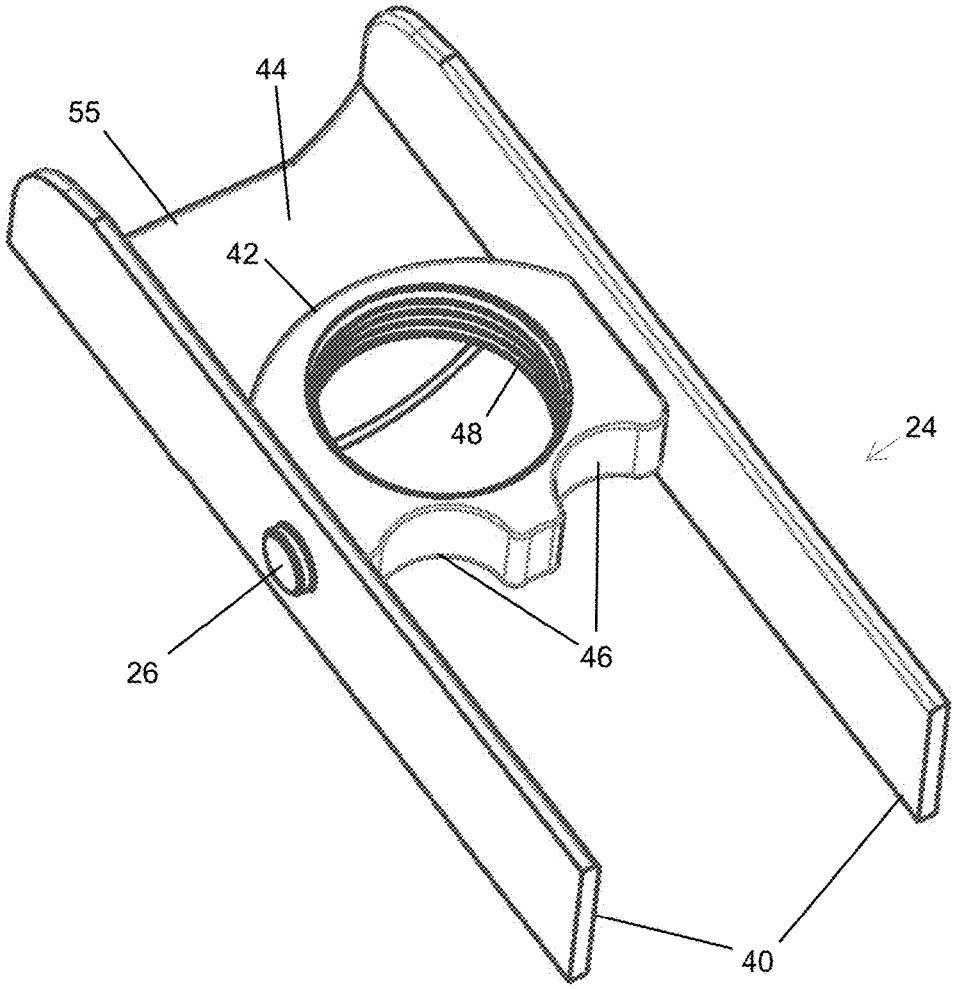
FIG. 6 shows a perspective view of a brace used to attach the top mount faucet of FIG. 1 to a countertop with the legs in a perpendicular position to the threaded rod of the top mount faucet.
Figure 7:
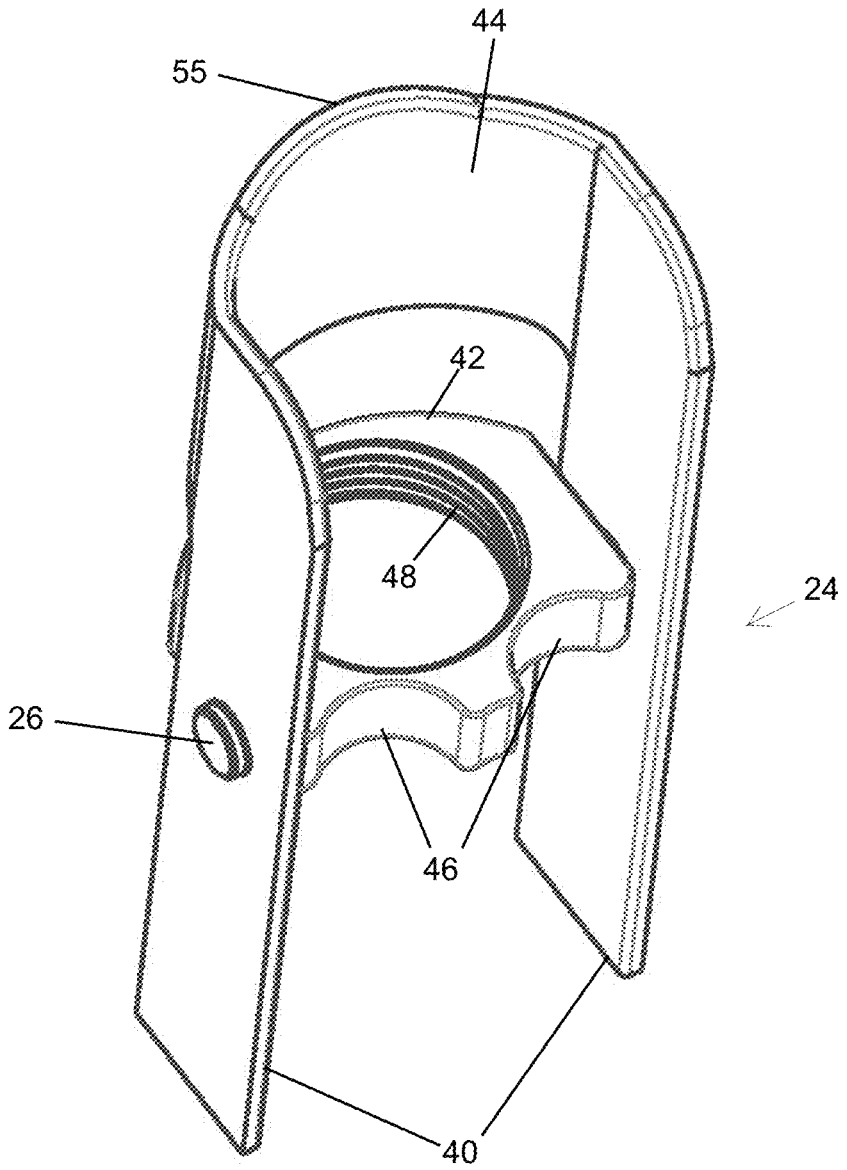
FIG. 7 shows a perspective view of the brace of FIG. 6 with the legs in a parallel position to the threaded rod of the top mount faucet.

Special attention is now paid to the brace 24 in FIGS. 6 and 7. The brace 24 is shown in FIG. 6 with the legs 40 in a position that would place them perpendicular to the threaded rod 22, as shown in FIG. 5. In such a position, the overall length of the legs 40 is greater than the diameter of the mounting hole 52 in the countertop 32 (see FIG. 4). The brace 24 is then able to prevent the faucet 10 from being removed from the countertop 32 after the brace 24 and threaded rod 22 are properly torqued with the tool 38. The brace 24 is also shown in FIG. 7 in a position placing it parallel 57 to the threaded rod 22 as shown in FIGS. 1 and 2. The brace 24 includes pivot 26 which enables the legs to freely pivot about the threaded nut 42.

The bridge 44 of the brace 24 includes a curvature forming arch 55. The arch 55 allows the bridge 44 to "hug" the threaded rod 22 when in the parallel 57 position as is shown in FIG. 2. The pivot 26 of the brace 24 is also offset from the centerline of the threaded nut 42, as best seen in FIG. 6. The offset ensures that the legs 40 will always swing in the proper pivoting motion 54, as shown in FIG. 4, as the tool 38 rotates the threaded rod 22.

The brace 24 also includes hot and cold supply line cradles 46 seen in FIGS. 6 and 7. These cradles 46 allow the hot and cold water supply lines 56 (FIG. 4) to nest against the threaded nut 42. The nesting of the hot and cold supply lines helps prevent the threaded nut 42 from spinning as the tool 38 is used to rotate the threaded rod 22 and draw the brace 24 towards the bottom 36 of the countertop 32 (see FIG. 4). Threads 48 on the brace 24 allow it to engage threads on the threaded rod 22, thereby causing the brace 24 to be drawn towards the base 8 of the faucet 10 when the threaded rod 22 is rotated in one direction with the tool 38 and also moves the brace 24 away from the base 8 of the faucet 10 when the threaded rod 22 is rotated in the opposite direction.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

I claim:

1. A faucet-to-countertop fastening system comprising:

a faucet body with a base configured to rest against a countertop and an internal cavity extending throughout a vertical axis of the faucet body;

a spout retainer coupled to the faucet body and configured to releasably couple a spout to the faucet body, the spout retainer providing a passage to the internal cavity of the faucet body along the vertical axis;

a threaded rod extending along at least a portion of the internal cavity and protruding from the base;

a water delivery hose passed entirely through the threaded rod; and a brace with a central, female threaded nut configured to engage the threaded rod and a pair of legs extending from the nut at opposing sides, wherein the pair of legs are joined together at the nut thereby allowing the pair of legs to pivot about a horizontal axis of the nut, and wherein the nut includes at least one externally facing line cradle;

wherein the threaded rod is configured to rotate about the vertical axis via access provided by the spout retainer while remaining in the internal cavity of the faucet body, thereby drawing the brace towards the base of the faucet body.

2. The faucet-to-countertop fastening system according to claim 1, wherein the brace includes a bridge joining the pair of legs on a first side of the nut, and wherein, on a second side of the nut, the pair of legs are not joined.

3. The faucet-to-countertop fastening system according to claim 2, wherein the bridge forms an arch with a curvature complementary to at least one of a curvature of the threaded nut and a curvature of the threaded rod.

4. The faucet-to-countertop fastening system according to claim 2, wherein the bridge has a curvature that matches a curvature of the threaded rod.

5. The faucet-to-countertop fastening system according to claim 4, wherein the brace is pivotable between at least a parallel position and an orthogonal position with respect to the threaded rod, and wherein when the brace is in the parallel position, the threaded rod is received within the bridge.

6. The faucet-to-countertop fastening system according to claim 1, wherein the horizontal axis of the threaded nut is offset from a center point of the threaded nut.

7. The faucet-to-countertop fastening system according to claim 1, wherein the brace is configured to pivot such that the pair of legs is parallel to the threaded rod during insertion of the threaded rod into a hole in the countertop, and the pair of legs pivots to be perpendicular to the threaded rod as the threaded rod is rotated.

8. The faucet-to-countertop fastening system according to claim 1, wherein the threaded rod includes a hollow passage extending through an entire length of the threaded rod.

9. The faucet-to-countertop fastening system according to claim 1, wherein the threaded rod is configured to be rotated, thereby drawing the threaded nut towards the base of the faucet body while the threaded nut and the pair of legs are not rotated.

10. The faucet-to-countertop fastening system according to claim 1, wherein the faucet body is configured to affix to and attach to the countertop without access to a space below the countertop.

11. The faucet-to-countertop fastening system according to claim 1, further comprising a tool configured for insertion into the cavity of the faucet body, opposite the base, to engage the threaded rod, thereby allowing a user to rotate the threaded rod.

12. The faucet-to-countertop fastening system according to claim 1, wherein the at least one externally facing line cradle includes a first line cradle disposed adjacent to a first leg of the pair of legs and a second line cradle disposed adjacent to a second leg of the pair of legs.

13. The faucet-to-countertop fastening system according to claim 12, wherein the first and second line cradles face a free end of the pair of legs.

14. The faucet-to-countertop fastening system according to claim 1, wherein a pivot axis of the brace is offset from a centerline of the threaded nut, the pivot axis also bisecting the threaded nut.

15. The faucet-to-countertop fastening system according to claim 14, wherein the pivot axis is offset in a direction towards the at least one externally facing line cradle on the brace.

16. A faucet-to-countertop fastening system comprising:

a faucet body with a base configured to rest against a countertop and an internal cavity extending throughout a vertical axis of the faucet body;

a spout retainer coupled to the faucet body and configured to releasably couple a spout to the faucet body, the spout retainer providing a passage to the internal cavity of the faucet body along the vertical axis;

a threaded rod extending along at least a portion of the internal cavity and a portion of the threaded rod protruding from the base, wherein the protruding portion is configured for insertion into a hole formed in the countertop, wherein the threaded rod includes a hollow passage extending through an entire length of the threaded rod;

a water delivery hose configured to be coupled to a spray head supported on the spout; and a brace with a central, female threaded nut configured to engage the threaded rod and legs extending from the nut at opposing sides, wherein the legs are joined together at the nut, thereby allowing the legs to pivot about a horizontal axis of the nut, wherein the brace includes a bridge joining the legs on a first side of the nut, wherein, on a second side of the nut, the legs are not joined, and wherein the brace is configured to pivot such that the legs are parallel to the threaded rod during insertion of the threaded rod into the hole in the countertop, and the legs pivot to be perpendicular to the threaded rod as the threaded rod is rotated, and wherein the nut includes externally facing hot and cold supply line cradles configured to nest against respective hot and cold supply lines;

wherein the threaded rod is configured to rotate about the vertical axis via access provided by the spout retainer while remaining in the internal cavity of the faucet body, thereby drawing the brace towards the base of the faucet body while the threaded nut and the legs are not rotated, and wherein when the hot and cold supply lines are nested against the hot and cold supply line cradles, the nut is prevented from spinning, and wherein the water delivery hose is passed entirely through the hollow passage of the threaded rod when the threaded rod and the brace are secured to the countertop.

17. The faucet-to-countertop fastening system according to claim 16, further comprising a tool configured for insertion into the internal cavity of the faucet body, opposite the base, to engage the threaded rod, thereby allowing a user to rotate the threaded rod.

18. The faucet-to-countertop fastening system according to claim 16, wherein the horizontal axis of the threaded nut is offset from a center point of the threaded nut.

19. The faucet-to-countertop fastening system according to claim 16, wherein the bridge forms an arch with a curvature complementary to at least one of a curvature of the threaded nut and a curvature of the threaded rod.

20. The faucet-to-countertop fastening system according to claim 19, wherein contact of the arch to the countertop as the threaded rod is rotated causes the legs to pivot from parallel to the threaded rod to perpendicular to the threaded rod.

* * * * *